United States Patent [19]

Shachaf

[11] Patent Number: 4,468,827

[45] Date of Patent: Sep. 4, 1984

[54] APPARATUS FOR MAKING INTERNALLY THREADED LOCK NUTS

[76] Inventor: Yitzik Shachaf, 3422 Avenue I., Brooklyn, N.Y. 11210

[21] Appl. No.: 355,868

[22] Filed: Mar. 8, 1982

[51] Int. Cl.[3] ..... B21D 53/24; B21D 53/22

[52] U.S. Cl. ..... 10/72 R; 10/73; 10/76 R; 72/354; 72/356

[58] Field of Search ..... 10/73, 74, 76 R, 80, 10/85, 86 A, 86 B, 86 F; 72/354, 356, 402; 10/72 R

[56] References Cited

U.S. PATENT DOCUMENTS

| | | | |
|---|---|---|---|
| 1,315,289 | 9/1919 | Dover | 10/85 X |
| 1,822,600 | 9/1931 | Olson | 10/73 X |
| 1,934,752 | 11/1933 | Wilcox | 10/86 F X |
| 2,205,871 | 6/1940 | Young | 10/86 F X |
| 2,287,214 | 6/1942 | Wilcox | 10/85 |
| 2,527,983 | 10/1950 | Brown et al. | 10/73 X |
| 3,453,672 | 7/1969 | Gohs | 10/73 |
| 4,389,871 | 6/1983 | Takeuchi et al. | 72/354 X |

*Primary Examiner*—E. Michael Combs

*Attorney, Agent, or Firm*—Goodman & Teitelbaum

[57] ABSTRACT

An apparatus for forming a lock nut from an annular workpiece including a support member having a central seat for receiving the annular workpiece. Fingers are radially displaceable with respect to the central seat for forcing peripheral indentations into the workpiece. A plunger is axially displaced with respect to the central seat for arcuately deforming the planar configuration of the workpiece. A threaded pilot is placed within the central set so that the fingers simultaneously press internal threads in the workpiece. The workpiece itself is formed of a continuous strip of material arcuately bent to form an annular member having a radially extending seam.

9 Claims, 10 Drawing Figures

APPARATUS FOR MAKING INTERNALLY THREADED LOCK NUTS

BACKGROUND OF THE INVENTION

This invention relates to lock nuts, and more particularly to an internally threaded lock nut, an apparatus for making such internally threaded lock nut, and a method for utilizing such apparatus.

In connection with hardware installation, it is common to provide an internally threaded lock nut for locking onto electrical boxes, mechanical devices, and occasionally plumbing fixtures. A typical lock nut which is utilized includes an annular body with radially extending locking tabs. The lock nut is arcuately shaped in plan, and is internally threaded. When threading onto a threaded post, the downwardly extending locking tabs will bite into a surface as the lock nut is tightened onto such surface.

Typically, such lock nuts are formed of steel or similar material, and are usually die cast or stamped into their final configuration. The internal threads are then tapped into the finally formed member.

While such methods of forming the lock nuts are well known, the molds or apparatus required for such methods are costly, frequently wear out, and present other problems. Accordingly, it would appear desirable to provide such internally threaded lock nuts by using other methods and apparatus.

SUMMARY OF THE INVENTION

Accordingly, it is an object of the present invention to provide an internally threaded lock nut which is formed from a continuous strip of material.

Another object of the present invention is to provide an internally threaded lock nut formed by arcuately bending a piece of continuous strip material about a central axis which is perpendicular to the strip material, thereby forming an annular member which can then be suitably deformed into a threaded lock nut configuration.

Still another object of the present invention is to provide an internally threaded lock nut formed of a continuous flat strip material shaped into an annular member by forming a seam between the distal ends of a section of the strip material.

Still another object of the present invention is to provide an apparatus for deforming an annular workpiece so as to form an internally threaded lock nut.

A further object of the present invention is to provide an apparatus which receives an annular member and presses indentations into the periphery of the annular member to thereby define the locking tabs between these indentations.

A further object of the present invention is to provide an apparatus for forming a lock nut which receives an annular member, forms deformations about the periphery thereof, and then arcuately shapes the annular member.

Yet a further object of the present invention is to provide an apparatus for forming an internally threaded lock nut which receives an annular member and presses it onto a threaded pilot so as to press internal threads into the annular member.

Another object of the present invention is to provide a method of forming an internally threaded lock nut from an annular member, by suitably deforming its shape.

Still another object of the present invention is to provide a method of forming an internally threaded lock nut by starting with a continuous strip of material, severing a section, bending the section about a central axis to form an annular member, and connecting the ends thereof to form a continuous annular member, and then deforming it into the desired shape of the threaded lock nut.

Briefly, in accordance with the present invention, there is provided an internally threaded lock nut which has an annular body portion with a plurality of peripherally spaced apart locking tabs radially extending from the body portion. The lock nut is characterized by a radially extending seam formed therein.

The present invention also contemplates an apparatus for forming the lock nut including a support member having a central seat which receives an annular workpiece. Finger members are radially displaceable with respect to the central seat for forcing peripheral indentations into the workpiece. A plunger is axially displaceable with respect to the central seat for arcuately shaping the workpiece.

In an embodiment of the present invention, a threaded pilot axially extends into the central seat forming a mandrill for the workpiece. As the finger members force the workpiece inwardly, it contracts onto the pilot thereby pressing internal threads into the workpiece.

The present invention also contemplates a method for forming a lock nut. The method includes the step of supporting an annular member onto a support seat. A plurality of radially extending fingers are then pressed into the periphery of the annular member to form indentations therein, thereby also forming locking tabs from the resultant material disposed between the indentations. A plunger is lowered onto the annular member to arcuately shape it in plan.

In an embodiment of the present invention, the initial annular member is formed by taking a strip of material and arcuately bending it about a central axis which is perpendicular to the plane of the strip material to thereby form the annular member. The ends of the strip are fastened together along a seam.

By placing a threaded pilot into the support seat, as the finger members inwardly press the periphery of the annular member, it will cause internal threads to be formed in the annular member.

The aforementioned objects, features and advantages of present invention will, in part, be pointed out with particularity and will, in part, become obvious from the following more detailed description of the invention, taken in conjunction with the accompanying drawings, which form an integral part thereof.

BRIEF DESCRIPTION OF THE DRAWINGS

In the drawings

In the various figures of the drawing, like reference characters designate like parts.

DESCRIPTION OF THE PREFERRED EMBODIMENT

Figure 1:
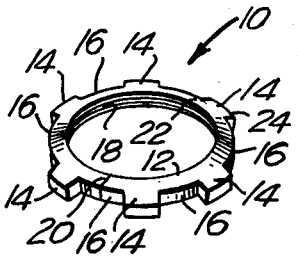
FIG. 1 is a perspective view of the internally threaded lock nut in accordance with the present invention.

Referring now to FIG. 1, the internally threaded lock nut of the present invention is shown generally at 10 and comprises an annular body portion 12 having peripherally spaced apart locking tabs 14 radially extending from the body portion and integrally formed therewith.

Indentations 16 are located between adjacent locking tabs 14. Threads 18 are internally formed in the annular body portion 12. A seam 20 is formed along the body portion, the portions thereof being fastened together by welding or any other suitable securing method. Although the seam 20 is shown formed along a body portion adjacent to an indentation 16, it should be understood that the seam could also be formed along a body portion and extending through a locking tab 14.

It is noted, that the lock nut is arcuately shaped so that the inner edge 22 is at a higher planar level than the outer edge 24.

The lock nut is utilized by threading it onto a threaded stem extending from a housing. As the lock nut threads onto the stem and reaches the housing, the locking tabs 14 bite into the housing and lock the nut in place. The lock nut could also be utilized in conjunction with regular nuts, and other hardware equipment to lock them in place.

Figure 2:
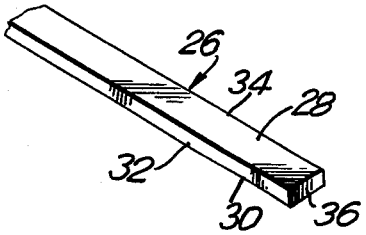
FIG. 2 is a perspective view of a section of a continuous strip material, from which the lock nut is to be formed.

The particular lock nut 10 shown in FIG. 1 is formed from a section of continuous strip material, as shown in FIG. 2. Specifically, there is shown a strip 26 of flat strip material. Such strip material can typically be made of steel, or the like. As shown, it is flat, having an upper surface 28 and a lower surface 30, with side surfaces 32 and 34. One end surface 36 is shown.

Figure 3:
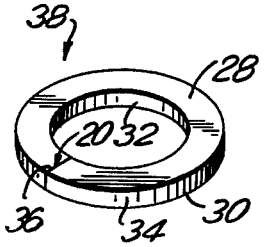
FIG. 3 shows an annular member formed from a cut section of continuous strip material of FIG. 2, and from which the internally threaded lock nut of FIG. 1 will be formed.

The strip of FIG. 2 would be cut into a unit length and bent into an annular member 38 as shown in FIG. 3. The annular member 38 is shown formed from a section of the strip material of FIG. 2, with the upper and lower surfaces of the annular member 38. One side surface 32 is now formed into the inner wall of the annular member, while the outer wall is formed by the side surface 34. One end 36 would be joined by an opposing end formed at the cut so as to define the seam 20 therebetween. The ends would then be welded, or fastened together by other means, so that the annular member 38 is continuous as shown.

A particular method of forming the annular member of FIG. 3 can be achieved by bending the section of the strip material around a mandrill, or other tool. In this way, the annular member is formed with the seam 20. It should be noted, that the seam 20 is unique to the present threaded lock nut. In the prior art, where the particular lock nut would be stamped or die cast, it would be formed of one continuous piece without any seams. Accordingly, the presence of the seam characterizes the formation of the annular member by the present invention and the subsequent formation of the lock nut from the annular member thereby formed.

Figure 4:
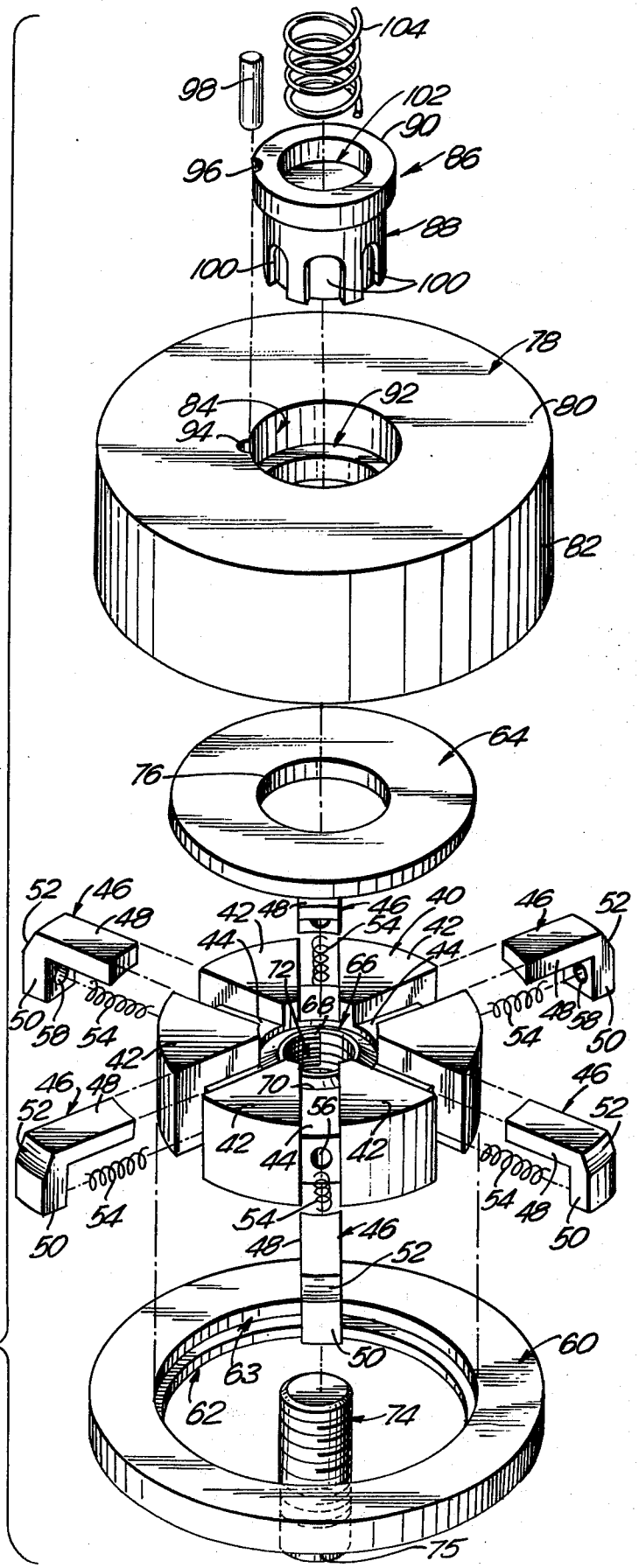
FIG. 4 is an exploded perspective view of the main portions of an apparatus for forming the internally threaded lock nut from the annular member of FIG. 3.

The apparatus which forms the threaded nut configuration of FIG. 1 from the annular member of FIG. 3 is shown in FIG. 4. The apparatus includes a cylindrical central block 40 sectioned into pie shaped sectors 42 which are interconnected by the shelves 44. The shelves 44 have their upper surface lying in a plane lower than the upper surface of the pie sectors 42, and also terminate radially inward of the periphery of the pie shaped sectors 42. The shelves 44 provide a seat for receiving the L-shaped finger members 46 when the finger members 46 are positioned between the pie sectors 42. The upper legs 48 of the finger members 46 overlie the upper surface of the shelves 44, while the vertical legs 50 of the finger members 46 move against the outer vertical peripheral edge of the shelves 44, both legs 48 and 50 being disposed between the pie sectors 42.

The outer interconnection between the upper leg 48 and the vertical leg 50 defines an angled cam surface 52. The finger members 46 are coupled to the shelves 44 and are biased in a radially outward position therefrom by means of the springs 54 which extend between the recesses 56 radially extending into the periphery shelves 44, and the corresponding recesses 58 radially extending into the inside of the vertical leg 50 of the finger members 46.

Figure 5:
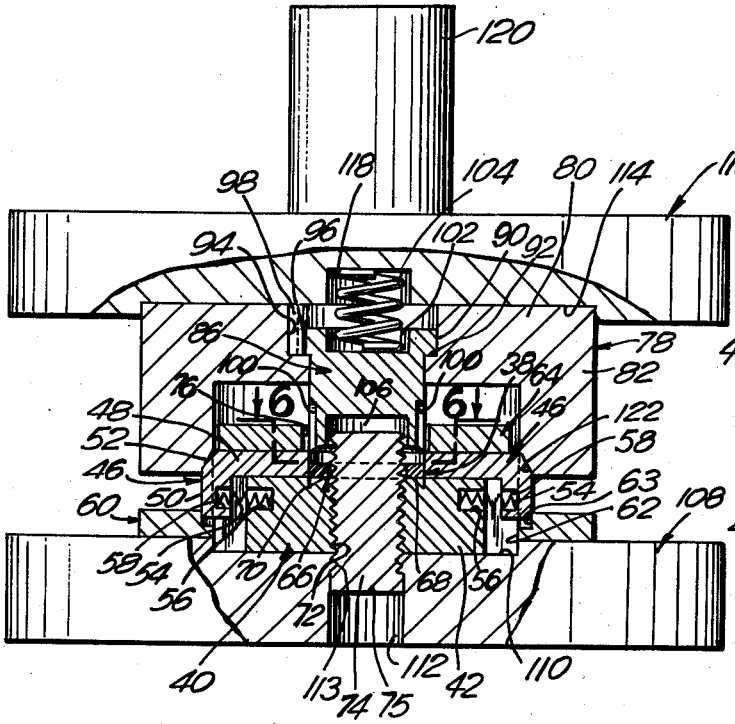
FIG. 5 is a partially sectioned elevational view of the apparatus showing an initial step in the formation of the threaded lock nut of FIG. 1 from the annular member of FIG. 3.

The central block 40, together with the finger members 46 positioned between the pie sectors 42 on the shelves 44, all fit within the annular support ring 60. Although the central block 40 passes through the opening 62 in the annular support ring 60, the finger members 46 have their outer edges fitting into the recess 63 formed internally of the annular ring 60, which forms an outer wall to limit to the radial extension of the finger members 46 outwardly from the central block 40, as best shown in FIG. 5.

An annular cover ring 64 fits over the top of the central block 40 and secures the finger members 46 in place preventing them from lifting out of the central block 40. Although not shown, the annular cover ring 64 is secured onto the top surface of the central block 40 by means of screws, welds, or other suitable fastening means.

Centrally formed within the section 40 is an annular seat 66 which is recessed below the upper surface of the pie sectors 42 and lies proximate the height of the upper surface of shelves 44. However, the seat 66 has an arcuately shaped surface which commences at the upper center portion 68 at a height substantially equal to the upper surface of the shelves 44, and terminates at its lower outer periphery 70 at a level lower than the upper surface of the shelves. This can best be seen in FIGS. 5, 7, 9 and 10.

The annular seat 66 is disposed about an internally threaded opening 72 extending through the block 40 so as to receive the externally threaded pilot member 74 which can extend upwardly therethrough. A central bore 76 is formed in the annular covering 64 to permit free access to the entire seat region 66. In fact, the opening 76 is made slightly larger than the outer periphery of the seat 66 to avoid possible interference with the seat 66 during operation. The threaded pilot member 74 can extend upwardly to a selected height above the seat 66, as is noted in FIGS. 5, 7 and 9.

An inverted cup shaped cover member 78 having an upper surface 80 and a depending peripheral wall 82 is available to fit over the central block 40 and its peripheral finger members 46. A central opening 84 is formed in the cover member 78 to receive a plunger 86 therein. The plunger 86 includes a cylindrical solid body portion 88 with an outwardly extending flanged head portion 90. The flange is retained in a seat 92 countersunk within the central opening 84 of the cover member 78 to prevent its passage entirely through the cover member. A semicircular axial notch 94 is formed at one point within the peripheral wall around opening 84, and a correspondingly semicircular notch 96 is formed within the peripheral flange 90 of the plunger 86. A locating pin 98 is insertable in the mating notches 94, 96 to accurately locate the plunger 86 at a desired position within the cover member 78, and prevent rotation therebetween.

A plurality of spaced apart archways or notches 100 are formed adjacent the lower end of the cylindrical body 88 of plunger 86. The archways 100 define thereunder indentations formed into the body 88 of the plunger 86. A counter sink 102 is formed into the flanged head 90 of the plunger 86 for receiving therein the tension spring 104. As can be noted in FIG. 5, a recess 106 is formed upwardly into the bottom of the cylindrical body portion 88 of the plunger 86 to permit receiving the upper end of the threaded pilot member 74, as will hereinafter be explained.

Figure 10:
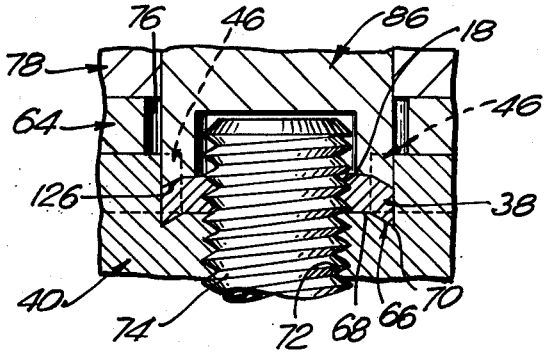
FIG. 10 is an enlarged cross sectional view showing the final formation of the workpiece in the apparatus.

The archway 100 formed about the outher peripheral wall of the body portion 88 cause the lower wall to be thninner where the indented archways exist, the lower wall being thicker between adjacent archways 100. The bottom edge of the lower wall of the body member 88 is arcuately shaped complementary to the arcuately shaped seat 66, as best shown in FIG. 10.

Referring now to FIG. 5, the operation of the apparatus as well as the method of forming the internally threaded lock nut will now be explained. The ring shaped annular support 60 is secured by suitable means onto a base 108 having a central recess 110 corresponding in size to the opening 62 formed in the support ring 60. This accommodates the central block 40 which sits into the recess 110. A central bore 112 extends entirely through the base member 108 to permit the threaded pilot member 74 to pass upward through the base member 108 and into the threaded opening 72 of the block 40. Preferably, only the upper end of bore 112 is reduced and threaded, as shown at 113, to limit the upward movement of the pilot member 74, wherein the pilot member 74 is provided with an unthreaded head 75 having the same size as the unthreaded portion of the bore 112.

The cover member 78, with the plunger 86 suitably positioned therein, is placed in a seat 114 contained in an upper clamping member 116. A recessed section 118 centrally formed in the seat 114 of the clamping member 116 accommodates the other end of the spring 104 so as to downwardly bias the plunger 86. The downward biasing of plunger 86 is limited by the flanged head portion 90 resting in the seat 92 of the cover member 78. A drive shaft 120 is coupled to the clamping member 116 and can be connected to a hydraulically operated device or other power driven device for downwardly pushing the clamping member 116 toward the base member 108. Initially, the clamping member 116 with the cover member 78 connected thereto is lifted off the lower housing block 40 to higher position than that shown in FIG. 5. The threaded pilot member 74 is inserted upwardly through the block 40 so as to extend thereabove and be positioned in the opening 76 of the cover ring 64. An annular workpiece 38, of the type shown in FIG. 3 is then placed into the opening 76 and onto the seat portion 66 of the block 40 so that the workpiece 38 fits about the pilot 74, as shown in FIGS. 5 and 6.

The upper clamping member 116 with the cover member 78 is then lowered to the position shown in FIG. 5. It should be noted, that the inner edge of the depending peripheral wall or rim 82 of the cover member 78 is angled at 122 to define a cam follower for engaging the cam surface 52 at the outer edge of the finger members 46. Accordingly, as the clamping member 116 is moved downwardly from its raised position, the cover member 78 also moves downwardly, until the cam follower 122 engages the cam surface 52, as shown in FIG. 5.

Figure 6:
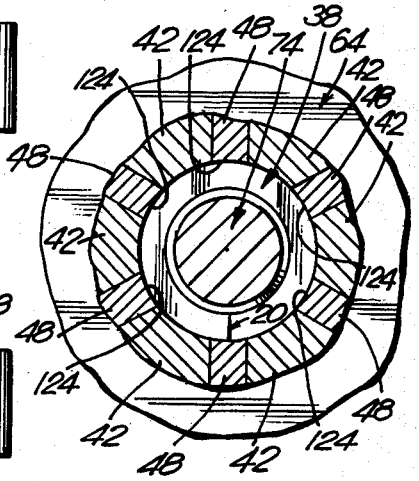
FIG. 6 is a cross sectional view taken along Lines 6—6 of FIG. 5, specifically showing the workpiece positioned in the apparatus.

As shown in FIGS. 5 and 6, the workpiece 38 is positioned about the threaded pilot member 74 and sits inwardly of the pie shaped sectors 42 and the horizontal legs 48 of the finger members 46, which serve to hold the workpiece 38 in place. It should be noted, that the forward edges of the legs 48 of the finger members 46 are arcuately curved at 124 to correspond in shape to the periphery of the annular workpiece 38, wherein the vertex portions of the pie shaped sectors 42 are also arcuately curved to correspond to the workpiece 38, as shown in FIG. 6.

Figure 7:
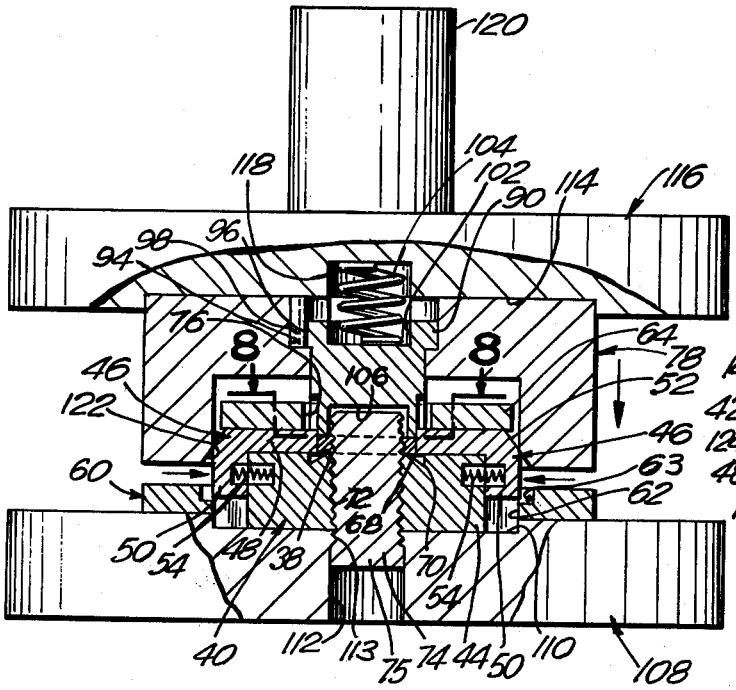
FIG. 7 is a partially sectioned elevational view similar to that shown in FIG. 5, showing a later stage in the operation, wherein the finger members form peripheral indentations in the annular workpiece.
Figure 8:
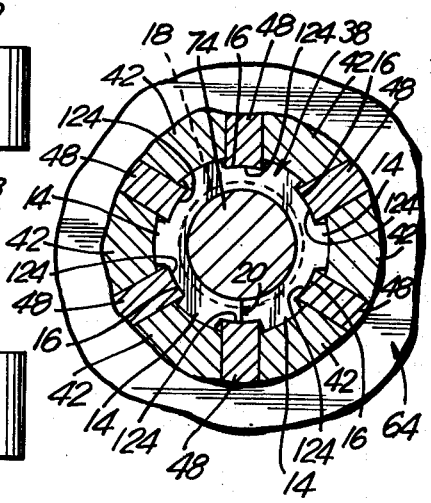
FIG. 8 is a cross sectional view taken along lines 8—8 of FIG. 7, specifically showing the indentations formed in the workpiece.

Referring now to FIG. 7, it will be noted that during continued downward movement of the cover member 78, the action of the cam follower 122 forces the finger members 46 inwardly toward the peripheral surface of the workpiece 38, this action opposing the bias force of the springs 54. This downward movement forces the finger members 46 to penetrate the periphery of the workpiece 38, as shown in FIG. 8, to thereby form the indentations 16 in the periphery of the workpiece. The untouched portions between adjacent indentations 16 define the locking tab portions 14.

Simultaneous with the formation of the indentations 16 about the periphery of the workpiece 38, the entire workpiece itself is moved inwardly so as to abut or clamp onto the threaded pilot member 74, thereby pressing the threads 18 internally into the annular workpiece 38.

As can best be seen in FIG. 7, the maximum inward movement of the finger members 46 is limited by having the inner surface of the vertical leg 50 abut the outer peripheral surface of the shelf 44 of the block 40 on which the finger members 46 rests. It should also be noted, that the downward movement of the cover member 78 brings the lower ends of the plunger 86 into contact with the upper surface of the workpiece 38 so as to hold it in place during such time as the finger members 46 move inwardly to form the indentations and the internal threads. This holding prevents the workpiece from moving or jumping upwardly. At the same time, the holding of the workpiece only results from the biasing force of the spring 104 and thereby no excessive force is exerted on the workpiece. It should also be noted, that the upper end of the threaded pilot member 74 enters into the recess 106 provided in the plunger 86. Thereby, the pilot member does not actually hit the plunger body itself.

Figure 9:
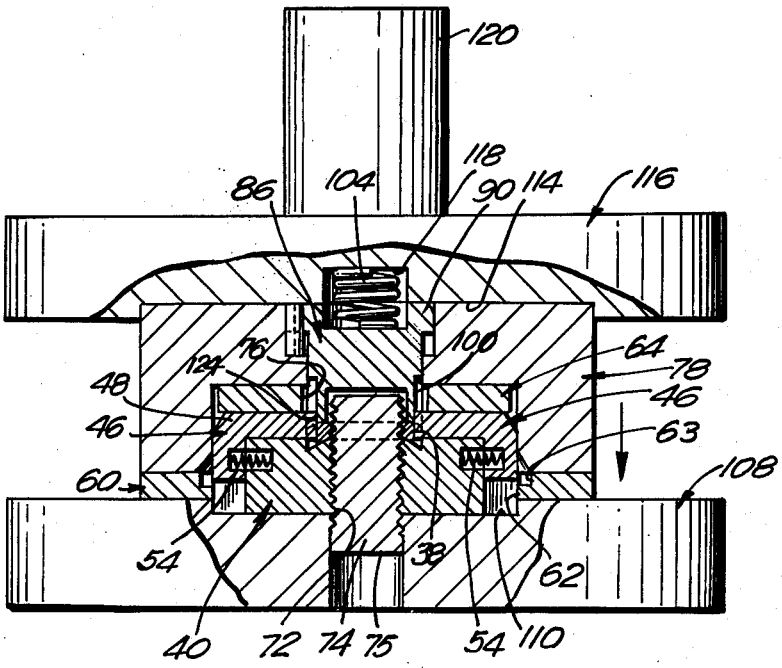
FIG. 9 is a partial cross sectional view similar to that shown in FIGS. 5 and 7, showing a still further step in the formation of the lock nut, specifically the lowering of the plunger to arcuately deform the planar configuration of the annular workpiece.

Referring now to FIG. 9, it will be noted that the continued downward movement of the clamping member 116 moves the cover member 78 further downward. Although the finger members 46 have already been moved inwardly the maximum extent, the continued downward movement now causes the upper wall of the seat 114 of the clamping member 116 to engage the top portion 90 of the plunger member 86 and force the plunger 86 downward so that the lower wall of the plunger 86 forcefully moves onto the workpiece 38 and arcuately deforms it.

The arcuate deformation can best be seen in FIG. 10, where it will be noted that the lower arcuate edge 126 of the plunger member 86 corresponds in shape to the arcuately shaped seat 66. As a result, the workpiece 38 is arcuately shaped to conform to the shape of the seat 66 by means of the force of the plunger 86. The seat 66 only has its periphery arcuately shaped while there is provided a flat portion 68 at the inner edge thereof so as not to deform the inner portion of the lock nut. As a result, the threaded sections 18 remain without deformation. It should also be appreciated that, as shown in FIG. 9, the archways 100 of the plunger 86 are available to accommodate the forward ends of the legs 48 of the finger members 46, and will not damage them as the plunger 86 forcefully moves downwardly.

Once the lock nut has been shaped and internally threaded, the clamping member 116 is then moved upwardly away from the base member 108 to its raised position. The pilot member 74 is then threaded downwardly below the area of the seat 66 so that the properly formed lock nut can be blown out of the seat 66 by conventional means known in the art. During this operation, the springs 54 push the finger members 46 outwardly to their original position as shown in FIG. 5.

The particular operation of the upper clamping member 116 was shown to be hydraulically driven, to in turn mechanically operate the finger members and the plunger. It should be appreciated, however, that the finger members themselves can be hydraulically driven and could be moved radially inwardly under direct hydraulic control.

Although the pie shaped sectors 42 and the central block 40 were shown formed of one piece construction, this could be formed of two separate sections. In doing so, an inner circular section would be the one having the central seat 66 and threaded opening 72 therethrough. The reason for this modification is that the inner circular portion of the block 40 might tend to get worn down during continued use, and accordingly, rather than replace the entire central block 40, only the inner section thereof having the central seat 66 and threaded opening 72 need be replaced if the block was a two piece construction as modified above.

There has been disclosed heretofore the best embodiment of the invention presently contemplated. However, it is to be understood that various changes and modifications may be made thereto without departing from the spirit of the invention.

What is claimed is:

1. Apparatus for forming an internally threaded lock nut comprising:

a support member having a central seat for receiving an annular workpiece having a planar configuration, said central seat being arcuately shaped;

threaded pilot means axially extending upwardly from said central seat to provide a mandrel for the workpiece and for pressing internal threads into the workpiece;

finger means disposed above said central seat and being radially displaceable with respect to said central seat for forming peripheral indentations into the workpiece and for coacting with said pilot means to form the internal threads, outer ends of said finger means including outwardly facing cam surfaces;

plunger means disposed above said central seat and being axially displaceable with respect to said central seat, said plunger means including an arcuately shaped lower face complementary to said arcuately shaped seat for coacting therewith for arcuately shaping the planar configuration of the workpiece;

clamping means for inwardly displacing said finger means to form the indentations and the internal threads in the workpiece;

said clamping means including a cover member for supporting said plunger means, said plunger means being axially spring biased within said clamping means and extending towards said central seat so that said plunger means holds the workpiece in a first downward position of said clamping means while said finger means deforms the workpiece;

said cover member including a depending peripheral flange provided with a cam follower for engaging said cam surfaces of said finger means for inwardly displacing said finger means towards said central seat to deform the workpiece; and drive means for driving said cover member downwardly in one continuous motion to said first downward position so that said finger means forms the indentations and internal threads in the workpiece while the workpiece is being held by the plunger means, and then to a lower second downward position so that said plunger means arcuately shapes the workpiece after the indentations and internal threads have been formed in the workpiece.

2. Apparatus as in claim 1, wherein said finger means are spring biased radially outwardly away from said central seat.

3. Apparatus as in claim 1, wherein said cover member is fitted over said support member so that said cover member engages said finger means.

4. Apparatus as in claim 3, wherein said cover member has a U-shaped cross-sectional configuration to provide a large bight portion with depending legs, said legs engage said finger means.

5. Apparatus as in claim 1, wherein a base member retains said support member, said pilot means extending upwardly from said base member and being threaded through a threaded hole in said support member so that a free end of said pilot means extends above said central seat.

6. Apparatus as in claim 1, wherein said plunger means includes peripheral archways adjacent its lower end for bridging the inwardly displaced finger means as the plunger engages the workpiece.

7. Apparatus as in claim 6, and further comprising locator means for arcuately positioning said plunger means in said cover member to prevent rotation therebetween so that the archways are positioned with respect to the finger means.

8. Apparatus as in claim 1, wherein said finger means are arcuately spaced apart by equal amounts and extend through said support member toward said seat.

9. Apparatus as in claim 8, wherein the inner ends of the finger means are arcuately shaped for contact with the workpiece.

* * * * *